US008607722B2

(12) United States Patent
Wrage et al.

(10) Patent No.: US 8,607,722 B2
(45) Date of Patent: Dec. 17, 2013

(54) AERODYNAMIC WIND PROPULSION DEVICE HAVING ACTIVE AND PASSIVE STEERING LINES AND METHOD FOR CONTROLLING OF SUCH A DEVICE

(75) Inventors: Stephan Wrage, Hamburg (DE); Bernd Specht, Hanstedt (DE); Stefan Wortmann, Hamburg (DE)

(73) Assignee: Skysails GmbH & Co. KG, Hamburg (DE)

( * ) Notice: Subject to any disclaimer, the term of this patent is extended or adjusted under 35 U.S.C. 154(b) by 317 days.

(21) Appl. No.: 12/809,359

(22) PCT Filed: Dec. 19, 2007

(86) PCT No.: PCT/EP2007/064270
§ 371 (c)(1),
(2), (4) Date: May 5, 2011

(87) PCT Pub. No.: WO2009/080098
PCT Pub. Date: Jul. 2, 2009

(65) Prior Publication Data

US 2012/0111251 A1 May 10, 2012

(51) Int. Cl.
*B63B 35/00* (2006.01)

(52) U.S. Cl.
USPC ..... 114/39.21; 114/39.29

(58) Field of Classification Search
USPC ..... 244/153 R, 155 A, 138 R, 142, 152, 145, 244/902; 114/39.21, 39.11, 39.12, 39.16, 114/102.1, 102.11, 102.16, 102.18, 102.22, 114/102.23, 102.29
See application file for complete search history.

(56) References Cited

U.S. PATENT DOCUMENTS

| | | | | |
|---|---|---|---|---|
| 6,514,115 | B2 * | 2/2003 | Harich | 446/34 |
| 6,877,697 | B2 * | 4/2005 | Bellacera | 244/155 A |
| 7,287,481 | B1 * | 10/2007 | Wrage et al. | 114/102.29 |
| 7,546,813 | B2 * | 6/2009 | Wrage | 114/102.1 |
| 7,672,761 | B2 * | 3/2010 | Wrage et al. | 701/21 |

FOREIGN PATENT DOCUMENTS

| | | | |
|---|---|---|---|
| DE | 10 2004 054 097 | A1 | 5/2006 |
| GB | 2 098 946 | A | 12/1982 |
| WO | WO 2005/100147 | A | 10/2005 |

OTHER PUBLICATIONS

International Search Report and Written Opinion, corresponding to PCT patent application No. PCT/EP2007/064270, date of mailing Sep. 19, 2008, 12 pages total.

* cited by examiner

*Primary Examiner* — Stephen Avila
*Assistant Examiner* — Anthony Wiest
(74) *Attorney, Agent, or Firm* — Kilpatrick Townsend & Stockton LLP; Kenneth R. Allen

(57) ABSTRACT

An aerodynamic wind propulsion device is provided, particularly for watercraft, in form of an aerodynamic wing connected to a steering unit located below the aerodynamic wing via a plurality of tractive lines, at least one pair of two active steering lines being connected to the aerodynamic wing at two points in distance and being coupled to a drive unit at the steering unit, a tractive cable, a first end of the tractive cable being connected at the steering unit to at least two of the tractive lines and a second end of the tractive cable being connected to a base platform, the aerodynamic wing having an aerodynamic profile which generates an uplift force, and two passive steering lines are connected to each other to form a continuous passive steering line section passing through the steering unit in order to passively follow a deformation of the aerodynamic wing.

30 Claims, 5 Drawing Sheets

AERODYNAMIC WIND PROPULSION DEVICE HAVING ACTIVE AND PASSIVE STEERING LINES AND METHOD FOR CONTROLLING OF SUCH A DEVICE

CROSS-REFERENCE TO RELATED APPLICATIONS

This application claims benefit under 35 USC §371 of PCT application PCT/EP2007/064270 havind an International Filing Date of Dec. 19, 2007.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to an aerodynamic wind propulsion device, particularly for watercrafts, comprising an aerodynamic wing being connected to a steering unit located below the aerodynamic wing via a plurality of tractive lines, at least one pair of two active steering lines being connected to the aerodynamic wing at two points in distance to each other and being coupled to at least one drive unit at the steering unit, a tractive cable, a first end of the tractive cable being connected at the steering unit to at least two of the tractive lines and a second end of the tractive cable being connected to a base platform, the aerodynamic wing having an aerodynamic profile which generates an uplift force in the direction of the tractive cable when the airflow direction is about perpendicular to the tractive cable.

A further aspect of the invention is related to a method for controlling an aerodynamic wind propulsion device, particularly for watercrafts, comprising the steps connecting an aerodynamic wing to a steering unit located below the aerodynamic wing via a plurality of tractive lines, connecting at least one pair of two active steering lines to the aerodynamic wing at two points in distance to each other and coupling said at least one pair of active steering lines to at least one drive unit at the steering unit, connecting a first end of a tractive cable at the steering unit to at least two of the tractive lines and connecting a second end of said tractive cable to a base platform, and applying steering forces to said at least one pair of active steering lines. Description of Related Art including information disclosed under 37 CFR 1.97 and 1.98

The following patents and publications were cited in an International Search Resort against the priority application as defining the general state of the art which is not considered to be of particular relevance: WO2005/100147 A (Oct. 27, 2005); DE 10 2004 054097 A1 (May 11, 2006); GB 2,096,946 A (Dec. 1, 1982); U.S. Pat. No. 7,287,481 B1 (Oct. 30, 2007).

Today, carbon-based fuels like diesel or heavy fuel oil (HFO) are used as a key resource for propelling nautic vessels. Mostly, diesel engines are used to provide the driving force for the vessels. With increasing costs for such carbon-based resources it becomes attractive to apply alternative methods for providing the driving force for nautic vessels.

WO 2005/100147 A1 discloses a positioning device for controlling a wing element which is connected via a tractive cable to a ship to serve as main or auxiliary drive. Such propulsion systems based on wing elements flying at high altitude and pulling the ship via a tractive force require large-scale wing elements and the control of such wing elements is a challenging task. In WO 2005/100147 A1 it is proposed to veer out or haul in the tractive cable in response to the flight condition of the wing element. Whereas by such a control mechanism a certain degree of flight control can be achieved, it is not sufficient to control the wing element in all flight conditions, in particular when the wind changes its strength or direction significantly.

To improve steerability of such wing elements in difficult wind conditions it is known from WO 2005/100148 A1 to couple a steering unit close below the wing element via a number of control lines and to connect the wing element to the nautic vessel via such a steering unit by a tractive cable extending between the nautic vessel and the steering unit. By this, control of the wing element can be improved but it is still a challenging task to control the wing element and specifically to steer the flight path of the wing element.

WO 2005/100149 A1 proposes various sensors to improve control of a wing element towing a nautic vessel. Whereas these and the former techniques may improve the steerability of aerodynamic wing elements it remains still a quite challenging task to efficiently steer an aerodynamic wing element and control its flight path and conditions in an efficient way.

To improve steerability during starting and landing manoeuvres, WO 2005/100150 proposes a telescopic mast erected onto the foredeck of the nautic vessel close to the fixing point of the tractive cable coupling the wing element to the nautic vessel. Using such mast, the wing element can be directly coupled to the top of the mast. Whereas such a technique may significantly improve manoeuvrability of the wing element during starting and landing procedure, the challenging task to improve the steerability of the wing element in various flight conditions and to improve the efficiency of such a steering technique remains.

SUMMARY OF THE INVENTION

According to the invention, an aerodynamic wing for a watercraft is provided, the aerodynamic wing being connected to a steering unit located below the aerodynamic wing via a plurality of tractive lines, at least one pair of two active steering lines being connected to the aerodynamic wing at two points in distance to each other and being coupled to at least one drive unit at the steering unit, a tractive cable, a first end of the tractive cable being connected at the steering unit to at least two of the tractive lines and a second end of the tractive cable being connected to a base platform, the aerodynamic wing having an aerodynamic profile which generates an uplift force in the direction of the tractive cable when the airflow direction is about perpendicular to the tractive cable.

Further according to the invention, a method for controlling an aerodynamic wing for a watercraft is provided, the method comprising the steps of connecting an aerodynamic wing to a steering unit located below the aerodynamic wing via a plurality of tractive lines, connecting at least one pair of two active steering lines to the aerodynamic wing at two points in distance to each other and coupling said at least one pair of active steering lines to at least one drive unit at the steering unit, connecting a first end of a tractive cable at the steering unit to at least two of the tractive lines and connecting a second end of said tractive cable to a base platform and applying steering forces to said at least one pair of active steering lines.

It is a first object of the present invention to provide a device facilitating and improving the control and/or steerability of an aerodynamic wing.

It is a further object of the invention to improve the load-bearing distribution and force transmission within and across the device.

It is a further object of the invention to improve the efficiency of the device.

According to a first aspect of the invention, an aerodynamic wind propulsion device as mentioned above is provided, characterized by a pair of two passive steering lines, wherein each of the two passive steering lines comprises a lower section and an upper section, wherein a second end of the lower section of each passive steering line is connected to a first end of the upper section of the respective passive steering line via a connecting member, second ends of the upper sections of the two passive steering lines are connected to the aerodynamic wing at two points in distance to each other, and first ends of the lower sections of the two passive steering lines are connected to each other in the region of the steering unit to form a continuous passive steering line section passing through the steering unit in order to passively follow a deformation of the aerodynamic wing induced by steering forces applied to said at least one pair of active steering lines.

The aerodynamic wind propulsion device according to the invention consists of several entities that are coupled or connected to each other. The term connected is used in this context to have the meaning that the two entities being connected are directly or indirectly secured, fastened or attached to each other. An indirect connection may further comprise a connecting element or connecting member that physically establishes the connection between the entities. The term coupled is used in the present context to describe a functional relationship or engagement, respectively, between the coupled elements such that an element coupled to another element has an effect on the other element, e.g. a gear to a toothed belt or a pulley to a belt.

The tractive lines of the aerodynamic wind propulsion device primarily accommodate forces resulting from the uplift force generated by the aerodynamic profile of the aerodynamic wing. These tractive forces are transferred to the tractive cable via the steering unit, thus connecting the base platform to the aerodynamic wing via the tractive lines, the steering unit and the tractive cable.

The aerodynamic wing is formed in an aerodynamic profile to thus generate the uplift force and may be formed as a hollow body and may comprise one or more openings in order to allow an air stream to enter and/or leave the interior of the aerodynamic wing and inflate and/or deflate the aerodynamic profile, respectively.

The steering lines function as means for controlling and changing the geometry of the aerodynamic wing and consequently affects its flight direction or properties, respectively, thus allowing to steer the flight path of the aerodynamic wing. The at least one drive unit located at the steering unit is coupled to at least one pair of active steering lines, such that an activation of the at least one drive unit results in shortening and/or lengthening of said two active steering lines. This way steering forces can be applied to the active steering lines and transferred to the aerodynamic wing in order to change its orientation and/or flight direction or properties, respectively.

It is to be understood that the two active steering lines may be formed by a single continuous active steering line running through or adjacent to the steering unit.

The term active is used in this context to describe that the steering lines are coupled to a drive unit that can be driven to apply steering forces to the active steering lines in order to shorten and/or lengthen the active steering lines on one side and/or the other side of the drive unit, respectively, and transfer the steering forces to the aerodynamic wing. In the context of this application, shortening a line is equivalent to hauling in that line and lengthening a line is equivalent to veering out that line. The steering lines can be coupled to the drive unit directly, via a gear or via a pulley or via other coupling means.

The aerodynamic wind propulsion device according to the first aspect of the invention further comprises a pair of passive steering lines with their lower sections preferably connected to each other to form a continuous passive steering line section. The term passive in this context indicates, that basically no directly and actively applied forces are transferred to these lines via a driven unit. Primarily, forces are accommodated or movements performed as a passive reaction to forces or movements applied or generated by the deformation of the aerodynamic wing itself. Thus, other than the active steering lines, the continuous passive steering line section typically is not coupled to a drive unit applying steering forces.

The continuous passive steering line section consists of the two lower sections of the pair of two passive steering lines, said two lower sections being connected to each other with their first ends so that they form a continuous passive steering line section extending through or along the steering unit or a pulley or the like connected to the steering unit. The upper sections of the two passive steering lines are connected with their ends to the second ends of the respective lower sections of the two passive steering lines. The second ends of the upper sections of the passive steering lines are connected to the aerodynamic wing at two points in distance. In this way these two points in distance at the aerodynamic wing are connected to each other via the upper sections of the two passive steering lines and the continuous passive steering line section formed by the lower sections of said two passive steering lines. It is to be understood that all the passive steering line sections are preferably formed by one continuous passive steering line.

Thus, in case the aerodynamic wing changes its orientation and/or flight direction or properties, respectively, such that one of said two points in distance at the aerodynamic wing changes its location in respect to the other one of the two points in distance, the continuous passive steering line section accommodates and assists for this change by passively following the movements and/or deformation of the aerodynamic wing. These movements and/or deformation of the aerodynamic wing may at least partially result from the steering forces that are applied to the active steering lines and transferred to the aerodynamic wing. Thus, while the active steering lines transfer the steering forces that are applied by the drive unit to the aerodynamic wing, the passive steering lines primarily accommodate forces resulting from a deformation of the aerodynamic wing and passively mirror the shortening and/or lengthening of the active steering lines, in order to passively follow the movement and deformation of the aerodynamic wing. When the orientation of the aerodynamic wing and/or its flight direction or properties, respectively, are stable and no steering forces are applied to the active steering lines, the passive steering lines are substantially free of passive steering forces but may accommodate tractive forces resulting e.g. from the uplift force generated by the aerodynamic profile of the aerodynamic wing.

The invention may be improved in that the at least one continuous passive steering line section is guided via a passive pulley located at the steering unit. The pulley may also be located close to the steering unit. A passive pulley in this context is understood as a pulley that can be rotated by a line that is guided via said pulley, but does not actively apply frictional forces to the line in order to shorten or lengthen the line on one side with respect to the pulley. In the current embodiment a passive pulley is used to guide the continuous passive steering line section at the steering unit, to transfer uplift forces and to allow the continuous passive steering line section to passively follow a deformation of the aerodynamic wing.

According to a further aspect of the invention, an aerodynamic wind propulsion device as mentioned above or described in the introductory portion of this description is provided, that is characterized in that the first end of the tractive cable is directly secured to a connecting element, e.g. a bolt or a pulley, located at the steering unit, and in that at least one of the tractive lines is also directly secured to said connecting element, and said connecting element is adapted to transfer tractive forces between the tractive cable and said at least one tractive line.

According to this embodiment the load-bearing distribution and force transmission at the steering unit is improved. The tractive forces acting on the steering unit execute significant internal stress onto the steering unit, when the tractive cable is attached to one point at the steering unit and the tractive lines are attached to one or more different points at the steering unit that are distant from the attachment point of the tractive cable, because in such an arrangement the tractive forces have to be transferred from the tractive lines through the steering unit to the tractive cable. According to the current aspect of the invention, this disadvantage is overcome by directly fastening the tractive cable as well as at least one of the tractive lines to one common connecting element located at the steering unit. In this way the tractive forces between the tractive cable and the at least one tractive line may be transferred via the connecting element instead of being transferred across a part of the steering unit or the whole unit. The connecting element may take the form of a bolt, pulley, anchor, ring, lug or the like and may consist of a special material that is suitable to accommodate and transfer high forces.

The invention may be further improved in that the tractive cable and the at least one tractive line are wound around said connecting element. In order to provide a secure high-strength connection between the tractive cable, the at least one tractive line and the connecting element, it is preferred, that both the tractive cable and the at least one tractive line are wound around the connecting element. In this case the tractive cable or the at least one tractive line, respectively, may form a small loop or spiral around the connecting element. After winding the tractive cable and the at least one tractive line around the connecting element, the loose ends of the tractive cable and the at least one tractive line may be securely fastened to either the connecting element or to the remaining part of the tractive cable or the at least one tractive line, respectively.

According to a further aspect of the invention, an aerodynamic wind propulsion device as mentioned above or described in the introductory portion of this description is provided, wherein each of the two active steering lines comprises a lower section and an upper section, wherein a second end of the lower section and a first end of the upper section are connected to each other via a connecting member, and a second end of the upper section is connected to the aerodynamic wing at one of the two points in distance, and first ends of the two lower sections of the two active steering lines are connected to each other in the region of the steering unit to form a continuous active steering line section that is coupled to the at least one drive unit and passing through the steering unit, and that is characterized in that a first relieve line is guided via a first relieve line pulley located at the steering unit, a first end of the first relieve line is connected to the connecting member of one of the two active steering lines, and a second end of the first relieve line is connected to the connecting member of the other one of the two active steering lines.

In this embodiment a continuous active steering line section is provided in a similar manner as for the continuous passive steering line section described above. First ends of the two lower sections of the two active steering lines are fastened to one another and form the continuous active steering line section that is coupled to the at least one drive unit so that—other than the continuous passive steering line section—the at least one drive unit can apply forces to the continuous active steering line section. The drive unit may be coupled to the continuous active steering line section via a driven pulley. The drive unit may exert steering forces to the continuous active steering line section, preferably via the pulley, in order to shorten the continuous active steering line section with respect to one side and lengthen the continuous active steering line section with respect to the other side of a symmetry axis of the steering unit or the aerodynamic wing, respectively.

It is preferred that the aerodynamic wing and the steering unit each are basically formed symmetrically to a symmetry axis and that the symmetry axis of the steering unit and that of the aerodynamic wing substantially fall together thus forming a common symmetry axis. It is further preferred that also the arrangement of the lines connecting the aerodynamic wing to the steering unit is largely symmetric to that common symmetry axis. Shortening and lengthening a line that continuously passes through the steering unit on one side with respect to said symmetry axis therefore results in a respective lengthening or shortening of that line on the other side of said symmetry axis.

The second ends of the lower sections of the two active steering lines are attached to respective first ends of the upper sections of the two active steering lines via connecting members and the second ends of the upper sections of the two active steering lines are attached to two points in distance at the aerodynamic wing. Thus, these two points in distance at the aerodynamic wing are connected to each other via a loop formed by the upper sections of the two active steering lines and the continuous active steering line section consisting of the two lower sections of the two active steering lines. Therefore, the steering mechanism may activate these two points at the aerodynamic wing with respect to each other. For example, if the drive unit lengthens the continuous active steering line section with respect to one side of the symmetry axis, this results in an accordant shortening of the continuous active steering line section with respect to the other side of the symmetry axis. Thus, the two points in distance of the aerodynamic wing can be steered reciprocally.

The current embodiment also provides for a first relieve line that may be basically parallel to the continuous active steering line section. The ends of the first relieve line are preferably connected to said two connecting members, that connect the upper and lower sections of the two active steering lines. Alternatively, the ends of the first relieve line can be connected to the continuous active steering line section or the upper sections of the two active steering lines. The first relieve line is guided via a first relieve line pulley that is preferably located at or close to the steering unit.

In the context of the present invention, the first relieve line may be a line accommodating steering forces, forces resulting from the uplift force generated by the aerodynamic profile of the aerodynamic wing and/or forces resulting from a deformation of the aerodynamic wing. Thus, the first relieve line can act as a further active steering line, as a further passive steering line or as a further tractive line. If the first relieve line is used as a further steering line, the required steering forces may be split between the continuous active steering line section and the first relieve line.

In another case the first relieve line may not accommodate applied steering forces, but may accommodate forces resulting from the uplift force generated by the aerodynamic profile of the aerodynamic wing (especially if it serves as a further tractive line), and/or forces resulting from a deformation of the aerodynamic wing (especially if it serves as a further passive steering line). This case has the advantage, that the first relieve line accommodates forces other than applied steering forces and thus the continuous active steering line section may primarily only accommodate applied steering forces. In this way, the continuous active steering line section can be relieved from forces other than applied steering forces. Thus, the drive unit does not have to apply the steering forces against at least a part of the forces resulting from the uplift force generated by the aerodynamic profile of the aerodynamic wing and/or resulting from a deformation of the aerodynamic wing that are accommodated by the first relieve line.

This embodiment can be further improved in that the first relieve line pulley and the at least one drive unit are located at distant points at the steering unit.

It is preferred, that the first relieve line pulley and the at least one drive unit are spaced apart. It is particularly preferred, that the drive unit is located above the first relieve line pulley or vice versa in operational position of the device. Also, the active steering line section may be located above the first relieve line or vice versa.

The invention can be further improved in that the aerodynamic wing is connected to the connecting members of the two active or passive steering lines, respectively, via at least one further steering line or steering line section, respectively. It is preferred, that the aerodynamic wing is attached to the two steering lines not only via said upper line sections at said two points in distance but via a plurality of lines or line sections, respectively, at a plurality of points. It is especially preferred, that two groups of more than two lines or line sections, respectively, each are provided being connected to the aerodynamic wing at two groups of points, the two groups of points being located in the proximity of the two points in distance at the aerodynamic wing. It is further preferred that each of the steering lines or line sections, respectively, is connected to the connecting member of the respective active or passive steering line. This arrangement provides a plurality of upper steering line sections that are merged into one lower steering line section via the respective connecting member. This arrangement has the advantage, that the forces transferred via the steering lines are concentrated in the lower steering line sections but fan out towards a plurality of points at the aerodynamic wing and thus distribute the steering forces to these several points. This is particularly preferred in order to reduce the stress occurring at single points at the aerodynamic wing. Further, this can improve steerability of the aerodynamic wing, because a larger area of the aerodynamic wing is addressed via a plurality of points.

A further preferred embodiment of the invention is characterized in that a second relieve line is guided via a second relieve line pulley located at the steering unit, a first end of said second relieve line is connected to the connecting member of one of the two active steering lines, and a second end of said second relieve line is connected to the connecting member of the other one of the two active steering lines. This embodiment provides for a second relieve line, that can be basically parallel to the first relieve line and/or the continuous active steering line section. Similar to the first relieve line, the ends of the second relieve line may be connected to the connecting members connecting the respective upper and lower sections of the two active steering lines or to the continuous active steering line section or the upper sections of the two active steering lines. The second relieve line pulley that guides the second relieve line is preferably located at the steering unit between the first relieve line pulley and the at least one drive unit, above those two elements or below them. The second relive line pulley may alternatively be located close to the steering unit.

Similar to the first relieve line, the second relieve line may serve as a further active steering line, as a further passive steering line, or as a further tractive line, as described above with respect to the first relieve line.

It is preferred that the first and second relieve lines have different functions, e.g. the first relieve line serves as a second active steering line and the second relieve line serves as a further passive steering line and/or further tractive line. This way the advantages of the different functions of the relieve lines can be combined.

The invention can be further improved in that a pair of two steering lines or lower sections of a pair of two steering lines, respectively, are connected to each other in the region of the steering unit to form the relieve line or one of the relieve lines, respectively. This embodiment is particularly preferred in order to reduce the number of lines of the aerodynamic wind propulsion device. Especially if the relieve line or one of the relieve lines serves as a steering line, it is advantageous to form the relieve line or one of the relieve lines by connecting the lower sections of a pair of two existing steering lines to each other. In case that the relieve line or one of the relieve lines serves as a tractive line, the relieve line or one of the relieve lines may be formed by the lower sections of a pair of two tractive lines, which are connected to each other in the region of the steering unit.

The invention can be further improved in that one of the relieve line pulleys is located coaxially to the at least one drive unit at the steering unit. Thus, one of the relieve lines and the continuous active steering line section may be guided parallel to each other. This embodiment can also save space at the steering unit.

The invention can be further improved in that at least one of the relieve line pulleys is a passive pulley. The term passive pulley is used in this context with the connotation described above. This embodiment is particularly preferred in the case that the relieve line or one of the relieve lines, respectively, serves as a passive steering line or a tractive line.

In case that a relieve line serves as further active steering line, the pulley may be coupled to a drive unit and thus not be a passive pulley or the relieve line serving as an active steering line may be coupled to another means for applying steering forces. It is possible, that—in case there are two relieve lines—only one of the relieve lines is guided via a passive pulley or that both of the relieve lines are guided via a passive pulley each.

The embodiment can be further improved in that the first relieve line pulley is coupled to a second drive unit such that activation of at least one of the drive units results in shortening the continuous active steering line section or the first relieve line, respectively, with respect to one side and lengthening the continuous active steering line section or the first relieve line, respectively, with respect to the other side of a symmetry axis of the steering unit or the aerodynamic wing, respectively.

In this embodiment, the first relieve line may serve as an active steering line, and be coupled to a second drive unit. The second drive unit may be able to apply steering forces to the first relieve line. The second drive unit may be coupled to the first relieve line via a pulley, preferably via said first relieve line pulley. In this case the first relieve line pulley is an actively driven pulley. In this arrangement, the relieve line can be hauled in and veered out with respect to the sides of the symmetry axis on the steering unit or the aerodynamic wing, respectively.

The continuous active steering line section is coupled to the first drive unit, which applies steering forces to the continuous active steering line section such that the continuous active steering line section can be veered out and hauled in with respect to the sides of the symmetry axis of the steering unit or the aerodynamic wing, respectively.

The ends of the first relieve line and the continuous active steering line section may be connected to common connecting members thus forming a circular line so that the forces applied to the first relieve line and the forces applied to the continuous active steering line section can add up to a total steering force acting on the aerodynamic wing via the connecting members and the upper steering line sections. It is particularly preferred that both drive units apply steering forces in a coordinate manner. Therefore it is preferred that the activation of the drive units results in either a shortening of both the first relieve line and the continuous active steering line section with respect to one side of the symmetry axis of the steering unit or the aerodynamic wing, respectively, or in a lengthening of both the first relieve line and the continuous active steering line section with respect to that side of the symmetry axis and vice versa with respect to the other side of the symmetry axis. Depending on the arrangement of the lines with respect to the drive units, this can require both drive units to be driven in the same or in opposite directions to achieve acting of them in the same direction.

The invention can be further improved in that each of the drive units comprises a blocking device adapted to actively block, particularly in a mechanical manner, the respective drive unit in case of its failure.

In case of failure of a drive unit, e.g. due to breakage or malfunction, it is preferred that this driving unit is immediately blocked and prevented from operating or being turned e.g. by a fastening bolt, break or the like. It is further preferred that the respective line that is guided via said failed drive unit is prevented from moving, i.e. being shortened or lengthened with respect to one side or the other of the symmetry axis, for example by providing a clamp, draw roll, stopper, bracket or a fastener and activating it in case of the failure of the drive unit. In such case, steering forces can be applied by the remaining other drive unit, providing save-to-fail redundancy.

A further preferred embodiment is characterized in that the continuous active steering line section and the first relieve line are connected to each other to form a loop. The invention can be further improved in that the connecting member of at least one of the two active steering lines, preferably both, comprises a pulley, and said loop is guided via said pulley. Providing a loop or a continuous belt has the advantage, that problems occurring in transferring the forces at the end of lines and their connections can be avoided. Further, providing such a loop means that the function of the continuous active steering line section and the relieve line may be selected to be similar to thus provide redundancy and sharing of forces.

Preferably, the loop is formed by one continuous line, particularly a continuous belt. In addition it is preferred, that the loop is guided via two active devices at the steering unit that preferably are identical with the at least one drive unit and the first relieve line pulley, that is an active pulley coupled to a drive unit in this case.

The provision of two drive units is particularly preferred for activating said loop since a redundancy of the activation is provided. This arrangement is particularly useful, since the activation of the loop can be maintained in case of the failure of one of the drive units. In this case only the steering force of the remaining drive unit is applied. In this embodiment it is particularly preferred that each of the drive units includes a blocking device that is adapted to block the respective drive unit in case of its failure. This is particularly useful since in case of the absence of such blockage the loop or continuous belt may run through the pulley(s) without exerting a steering force onto the aerodynamic wing via the upper steering line sections and connecting members in case of the failure of one of the drive units.

The invention can be further improved in that one of said drive units is located below the other one at the steering unit, both drive units are coupled to drive pulleys located within the loop, and the loop is preferably pressed against the upper drive pulley by two guiding pulleys located at the steering unit.

In this embodiment it is further preferred, that the loop is pressed against at least one of the two drive units by two pulleys, particularly draw rolls, located on either side of the drive unit at the steering unit. This is particularly preferred for the upper drive unit with the loop passing on the upper side.

When the loop is acting as an active steering means, it is preferred that a second relieve line is provided and that said second relieve line serves as a further passive steering line or tractive line. In this arrangement it is further particularly preferred, that the second relieve line is guided by a second relieve line pulley located at the steering unit between said two drive units. In this preferred embodiment the activation of the loop is facilitated, since a part of the forces, particularly forces resulting from the uplift force generated by the aerodynamic profile of the aerodynamic wing and/or forces resulting from a deformation of the aerodynamic wing, are relieved from the loop and accommodated by the second relieve line. Thus, the drive units faces less forces against which the steering forces have to be applied.

In a further aspect, the invention may be embodied in a watercraft, comprising an aerodynamic wind propulsion device as described above. In this respect, reference is made to the international applications mentioned in the introduction of this description describing such systems for towing a watercraft.

Further, the invention may be embodied in the use of an aerodynamic wind propulsion device as described above to propel a watercraft.

According to a further aspect of the invention, a method for controlling an aerodynamic wind propulsion device, as described in the introductory part of this description, is provided, that is characterized by the steps of providing a pair of two passive steering lines, each of the two passive steering lines comprising a lower section and an upper section, connecting a second end of the lower section of each passive steering line to a first end of the upper section of the respective passive steering line via a connecting member, connecting second ends of the upper sections of the two passive steering lines to the aerodynamic wing at two points in distance to each other, and connecting first ends of the lower sections of the two passive steering lines to each other in the region of the steering unit to form a continuous passive steering line section passing through the steering unit. The method according to the invention can be improved by the step of guiding the at least one continuous passive steering section line via a passive pulley located at the steering unit.

According to a further aspect of the invention, a method for controlling an aerodynamic wind propulsion device, as mentioned above or described in the introductory portion of this description is provided, that is characterized by the steps of directly securing the first end of the tractive cable to a connecting element, e.g. a bolt or a pulley, located at the steering unit, directly securing at least one of the tractive lines to said connecting element, and transferring tractive forces between the tractive cable and said at least one tractive line via said connecting element. The method according to the invention can be improved by the step winding the tractive cable and the at least one tractive line around said connecting element.

According to a further aspect of the invention, a method for controlling an aerodynamic wind propulsion device, as mentioned above or described in the introductory portion of this description, is provided, comprising the steps of providing each of the two active steering lines with a lower section and an upper section, connecting second ends of the lower sections and first ends of the respective upper sections to each other via a connecting members, and connecting second ends of the upper sections to the aerodynamic wing at the two points in distance, and connecting first ends of the two lower sections of the two active steering lines to each other in the region of the steering unit to form a continuous active steering line section that is coupled to the at least one drive unit and passing through the steering unit, and that is characterized by the steps guiding a first relieve line via a first relieve line pulley located at the steering unit, connecting a first end of the first relieve line to the connecting member of one of the two active steering lines, and connecting a second end of the first relieve line to the connecting member of the other one of the two active steering lines.

The method according to the invention can be improved by the steps of primarily accommodating applied steering forces by the active steering lines or continuous active steering line section, respectively, and primarily accommodating steering forces, forces resulting from the uplift force generated by the aerodynamic profile of the aerodynamic wing and/or forces resulting from a deformation of the aerodynamic wing by the first relieve line. The method according to the invention can be further improved as described in claims 25-31.

As to the advantages, preferred embodiments and details of these further aspects and preferred embodiments, reference is made to the corresponding aspects and embodiments described above.

BRIEF DESCRIPTION OF THE DRAWINGS

Preferred embodiments of the invention shall now be described with reference to the attached drawings, in which.

DETAILED DESCRIPTION OF THE INVENTION

Figure 1:
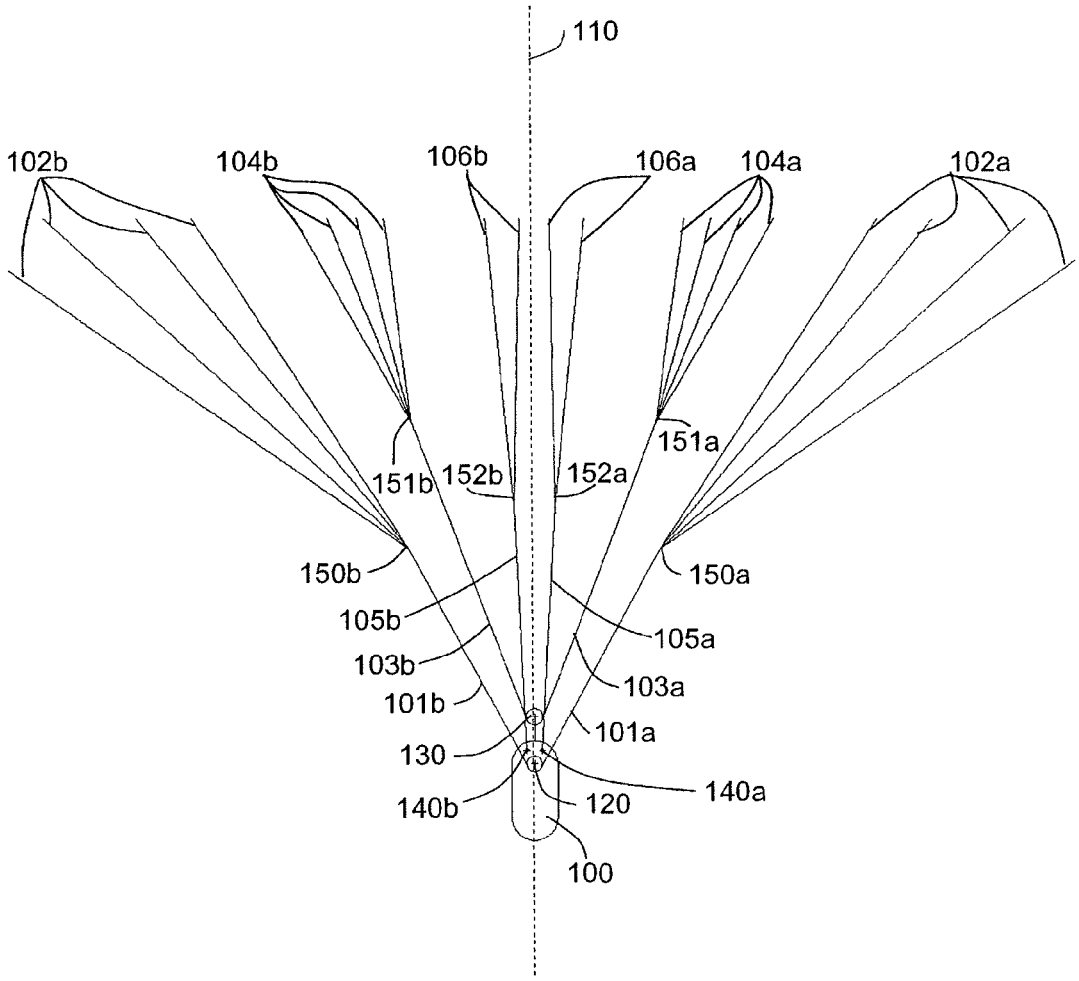
FIG. 1: shows a schematic partial view of a first embodiment of the invention with a steering unit, a pair of active steering lines, a pair of passive steering lines and a pair of tractive lines.
Figure 5:
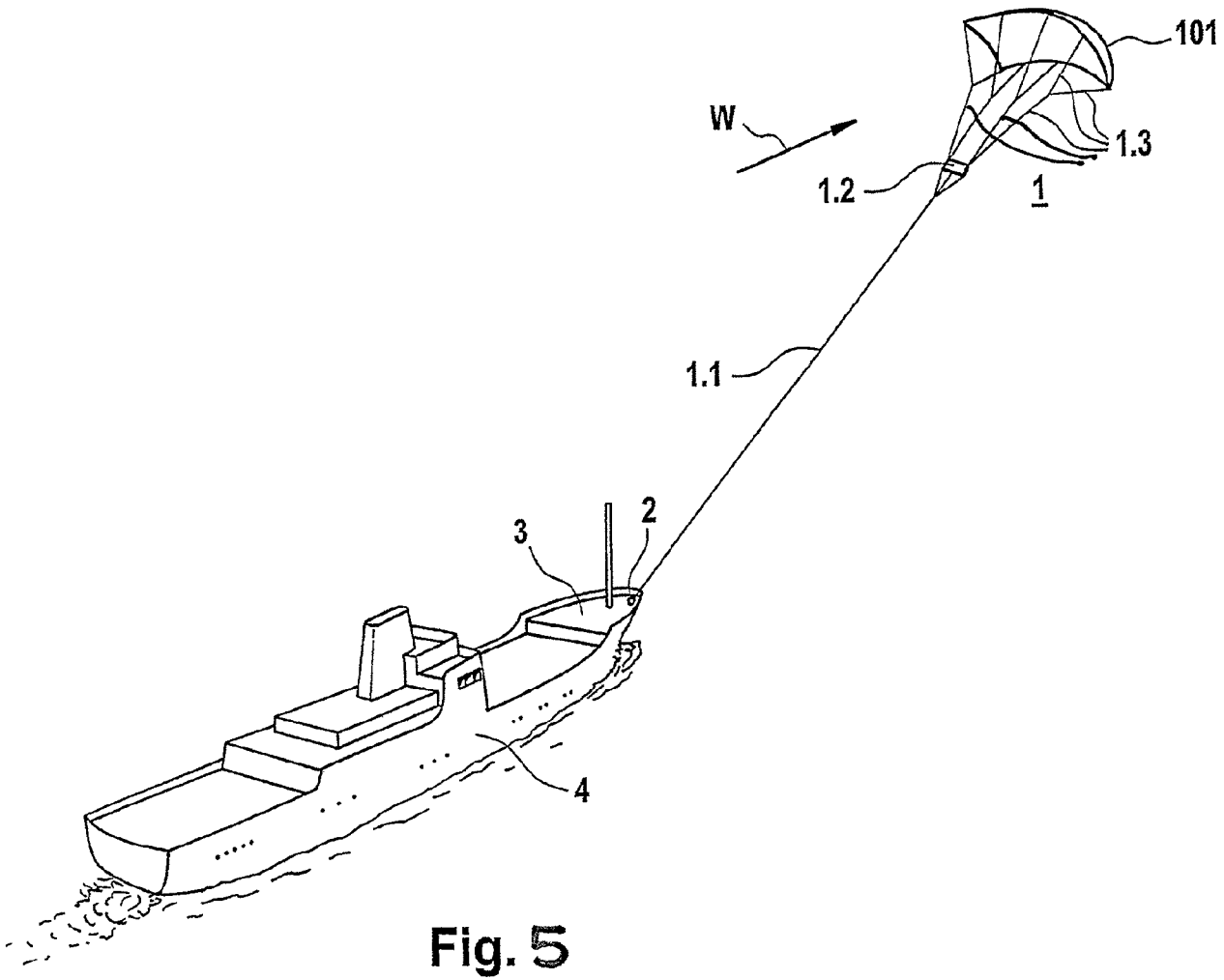
FIG. 5: shows a perspective view of an aerodynamic wing attached via plurality of lines to gondola that is tethered via a tractive cable to a base platform of a vessel.

FIG. 1 schematically shows a part of a first embodiment of the present invention, comprising a steering unit 100 in a gondola 1.2 (FIG. 5) that is connected to an aerodynamic wing (not shown) 101 via a plurality of lines 101-106 (FIG. 1), including one or more steering line components 1.3 (FIG. 5). This arrangement of a plurality of lines 101-106 will be described in further detail below. The gondola 1.2 is attached via a tractive cable 1.1 to an anchor 2 on a base platform 3 of a vessel 4.

A pair of active steering lines 101*a*, 102*a*, 101*b*, 102*b* is provided. Each of the two active steering lines 101*a*, 102*a* and 101*b*, 102*b* consists of a lower section 101*a, b* and an upper section 102*a, b*. The lower sections 101*a, b* of the two active steering lines are connected to each other in the region of the steering unit 100 thus forming one continuous active steering line section 101*a, b* passing through the steering unit 100. The continuous active steering line section 101*a, b* is connected to the upper sections 102*a, b* via connecting members 150*a, b*. The upper sections 102*a*, 102*b* are connected to an aerodynamic wing (not shown) at two points in distance. The upper line sections 102*a, b* are provided as a total of four load sharing line sections 102*a, b* each being connected with first ends to the connecting members 150*a, b* and with second ends to a plurality of adjacent points at the aerodynamic wing (not shown). As can be seen from FIG. 1, the plurality of further upper line sections 102*a, b* is divided into two groups, each group defining said upper line sections 102*a, b* for said lower line sections 101*a, b*.

The continuous active steering line section 101*a, b* is coupled to a drive unit 120 at the steering 100. The drive unit 120 may comprise a driven pulley that is coupled to an electric servo motor, wherein said motor activates the driven pulley to rotate in one or the other direction and thus moves the continuous active steering line section 101*a, b* in the respective direction. The activation of the drive unit 120 in a counter-clockwise direction results in a shortening of the continuous active steering line section 101*a, b* on the left hand side of the symmetry axis 110 of the steering unit 100 and a respective lengthening of the continuous active steering line section 101*a, b* on the right hand side of the symmetry axis 110. Vice versa, activation of the drive unit 120 in a clockwise direction produces a shortening of the continuous active steering line section 101*a, b* on the right hand side of the symmetry axis 110 and a lengthening of the continuous active steering line section 101*a, b* on the left hand side of the symmetry axis 110.

Further, a pair of passive steering lines 103*a*, 104*a* and 103*b*, 104*b* is provided. Each of the two passive steering lines 103*a*, 104*a* and 103*b*, 104*b* comprises a lower passive steering line section 103*a, b* and an upper passive steering line section 104*a, b*. The two lower passive steering line sections 103*a, b* are connected to each other to form a continuous active steering line section 103*a, b*. The upper passive steering line sections 104*a, b* are connected to the ends of the continuous passive steering line section 103*a, b* via connecting members 151*a, b*. The upper passive steering line sections 104*a, b* are connected to two points in distance at the aerodynamic wing (not shown). A total number of four upper passive steering line sections 104*a, b* are provided on each side and connected via the connecting members 151*a, b* to the lower passive steering line section 103*a, b*. Each group of four upper passive steering line sections 104*a, b* is secured at the aerodynamic wing. The continuous passive steering line section 103*a, b* is guided via a passive pulley 130 which is located in the proximity of the steering unit 100 and connected to the steering unit 100. Alternatively, the passive pulley 130 may be located directly within the steering unit 100.

A pair of tractive lines 105*a*, 106*a* and 105*b*, 106*b* is provided. The two tractive lines 105*a*, 106*a* and 105*b*, 106*b* consist of lower tractive line sections 105*a, b* and upper tractive line sections 106*a, b*. The lower sections 105*a, b* are connected to the respective upper tractive line sections 106*a, b* via connecting members 152*a, b*. The lower right tractive line section 105*a* is fastened to the steering unit 100 at a fixing point 140*a* and the left lower tractive line section 105*b* is fastened to the steering unit 100 at a fixing point 140*b*. The upper tractive line sections 106*a, b* are connected to the aerodynamic wing (not shown) at two points in distance and are provided as two load sharing lines 106*a, b*, each.

The pair of tractive lines primarily accommodates forces resulting from the uplift force generated by the aerodynamic profile of the aerodynamic wing. The arrangement of the active steering lines comprising the continuous active steering line section 101*a, b* and the plurality of upper active steering line sections 102*a, b* transfers steering forces applied by the drive unit 120 to the aerodynamic wing.

The arrangement of passive steering lines comprising the continuous passive steering line section 103*a, b* and the plurality of upper passive steering line sections 104*a, b* passively follows the movements and/or deformation of the aerodynamic wing (not shown), induced by the steering forces applied via the active steering lines to the aerodynamic wing. This is realized by the passive pulley 130, which allows the continuous passive steering line section 103*a, b* to execute a shortening on the left hand side of the symmetry axis 110 and a respective lengthening on the right hand side of the symmetry axis 110 and a lengthening on the left hand side of the symmetry axis 110 and a respective shortening on the right hand side of the symmetry axis 110 following symmetrically the respective lengthening and shortening of the continuous active steering line section 101*a, b*.

In this way the applied steering forces are directly transferred to a first plurality of points at the aerodynamic wing, where the plurality of upper active steering line sections 102*a, b* are connected, and passively transferred to a plurality of connection points at the aerodynamic wing, where the plurality of upper passive steering line sections 104*a, b* is connected to the aerodynamic wing.

Figure 2:
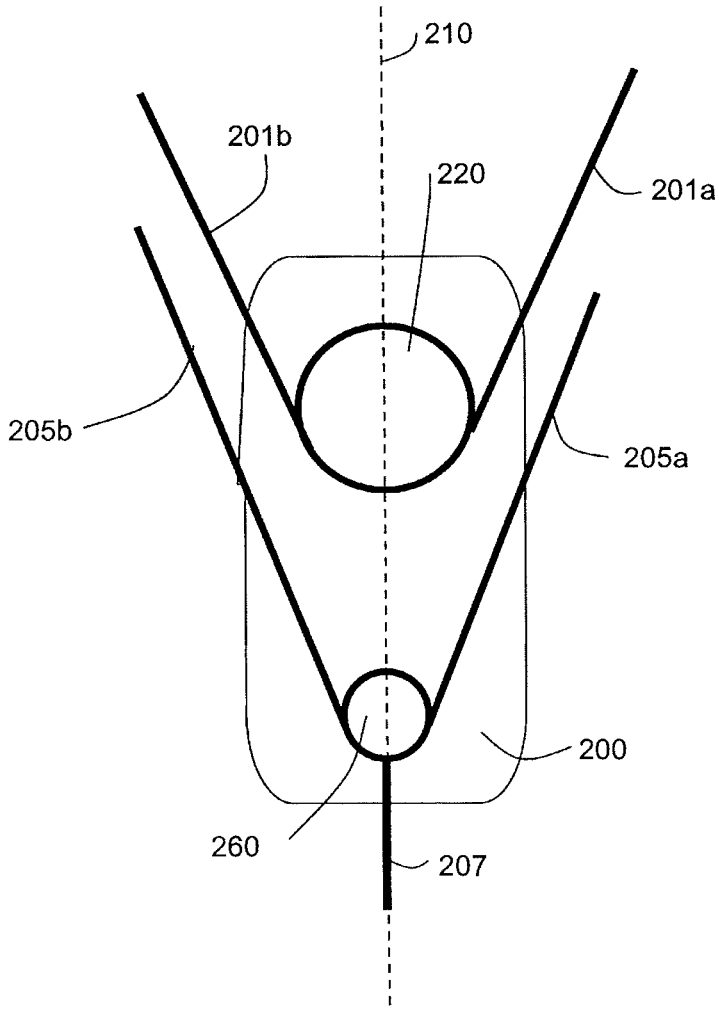
FIG. 2: shows a schematic view of a detail of a second embodiment of the invention with a steering unit and a connecting element to transfer tractive forces.

FIG. 2 shows a schematic view of a detail of a second embodiment of the present invention with a steering unit 200, a pair of steering lines 201*a, b*, a pair of tractive lines 205*a, b* and a tractive cable 207. The arrangement is symmetric with respect to a symmetry axis 210 of the steering unit 200. The pair of steering lines 201*a, b* is guided via a pulley 220, that may be coupled to an electric motor in case the steering lines 201*a, b* are active steering lines. The two tractive lines 205*a, b* are directly secured to a coupling element 260, that is adapted to transfer tractive forces from the tractive lines 205*a, b* to the tractive cable 207. The tractive cable 207 is also directly secured to said connecting element 260. This embodiment has the advantage, that the tractive forces are directly transferred via the connecting element 260 from the tractive lines 205*a, b* to the tractive cable 207, such that the steering unit 200 does not have to be dimensioned to accommodate and transfer these tractive forces across the steering unit 200. In this way it is possible to save weight of the steering unit 200 which is advantageous in respect to its flying properties.

The two steering lines 201*a, b* may be connected to form a continuous steering line or continuous steering line section, respectively, that is guided via the pulley 220 or they may be connected to the pulley 220 each. The tractive lines 205*a, b* may be connected to form a continuous tractive line, that is wound around the connecting element 260 or they may be directly secured to the connecting element 260 each. The connecting element 260 may take the form of a bolt, anchor, ring, lug or the like and may consist of a special material that is suitable to accommodate and transfer high forces.

Figure 3:
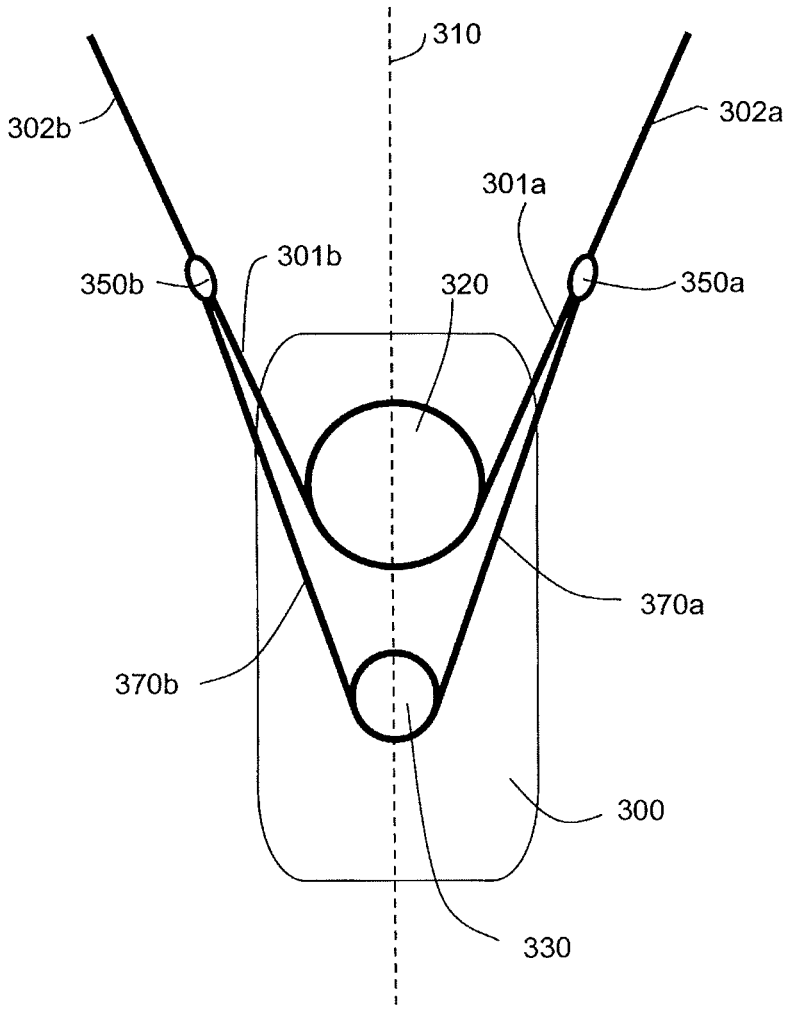
FIG. 3: shows a schematic view of a detail of a third embodiment of the invention with a steering unit, a continuous active steering line section and a relieve line.

FIG. 3 shows a schematic view of a detail of a third embodiment of the present invention with a steering unit 300 with a symmetric axis 310, a pair of active steering lines 302*a*, 301*a* and 302*b*, 301*b*, and a relieve line 370*a, b*. The pair of active steering lines consists of two active steering lines 302*a*, 301*a* and 302*b*, 301*b* with lower active steering line sections 301*a, b* and upper active steering line sections 302*a, b*, that are connected to the respective lower active steering line sections 301*a, b* via the connecting members 350*a, b*. The lower active line sections 301*a, b* are connected to each other in order to form a continuous active steering line section 301*a, b* that is guided via a driven pulley 320 that is coupled to a drive unit (not shown).

The relieve line consists of two sections 370*a, b* that are connected to each other in order to form one continuous relieve line 370*a, b* that is guided via a passive pulley 330 located at the steering unit 300. The relieve line 370*a, b* is also connected to the connecting elements 350*a, b*.

In this arrangement the relieve line 370*a, b* acts as a passive line, accommodating primarily forces resulting from the uplift force generated by the aerodynamic profile of the aerodynamic wing and/or forces resulting from a deformation of the aerodynamic wing. The continuous active steering line section 301*a, b* primarily accommodates steering forces applied by the drive unit that is coupled to the continuous active steering line section 301*a, b* via the driven pulley 320. An activation of the pulley driven 320 via the drive unit results in shortening the continuous active steering line section 301*a, b* on the left hand side of the symmetry axis 310 and lengthening the continuous active steering line section 301*a, b* on the right hand side of the symmetry axis 310 or vice versa, depending on the direction of orientation of the driven pulley 320. The relieve line 370*a, b* passively follows this shortening and/or lengthening accordingly via the passive pulley 330.

Figure 4:
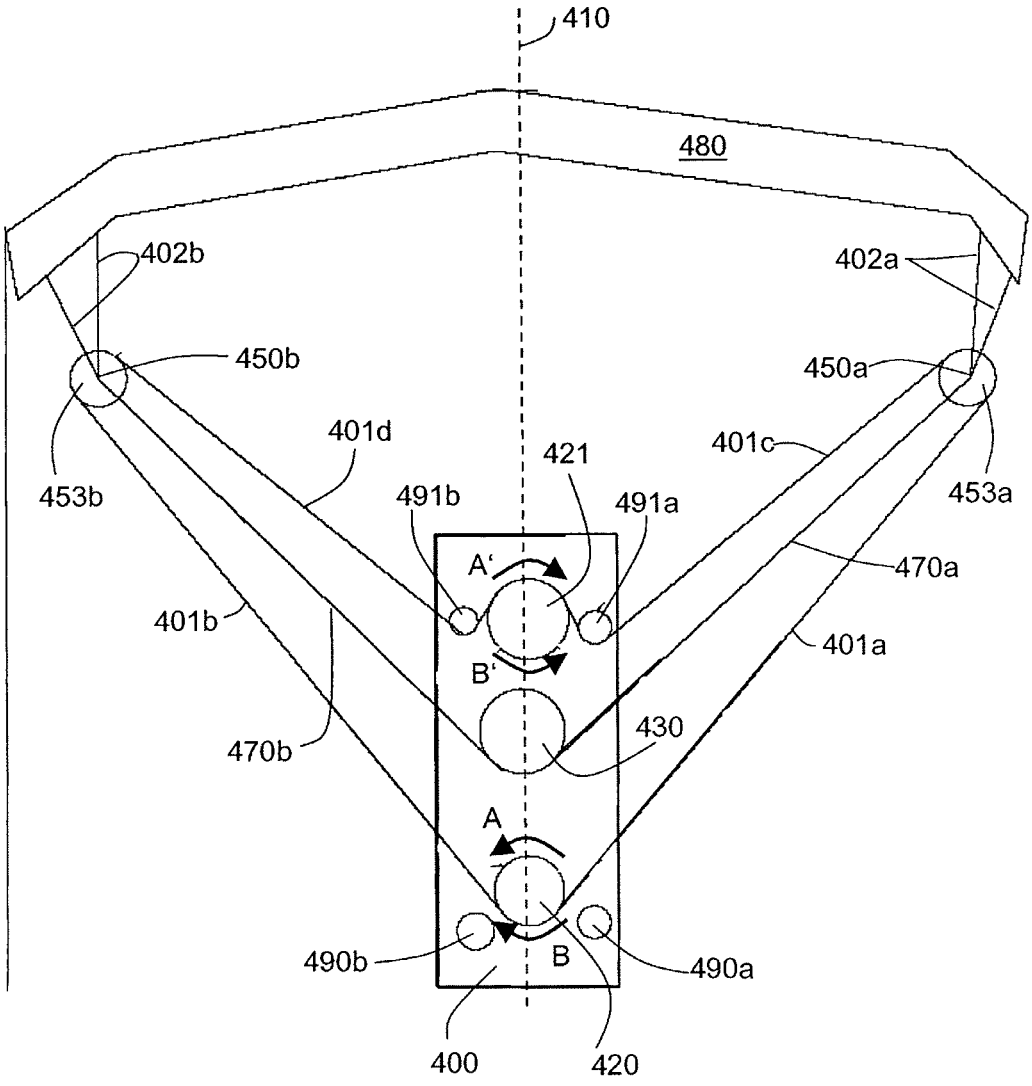
FIG. 4: shows a schematic partial view of a fourth embodiment of the invention with an aerodynamic wing, a steering unit, two drive units and a loop.

FIG. 4 schematically shows a part of a fourth embodiment of the present invention with an aerodynamic wing 480, a steering unit 400 and a common symmetry axis 410 of the steering unit 400 and the aerodynamic wing 480. Two driven pulleys 420 and 421 are located at the steering unit 400. Each of the two driven pulleys 420, 421 is coupled to an electric motor (not shown). Between the two driven pulleys 420, 421 a passive pulley 430 is located. A relieve line 470*a*, 470*b* is connected to a first connecting element 450*a* and a second connecting element 450*b*. These connecting elements 450*a, b* are connected to the aerodynamic wing 480 via four upper line sections 402*a, b*. The connecting members 450*a, b* each comprise a pulley 453*a, b*. A continuous belt or loop consisting of the sections 401*a, b* and 401*c, d* is coupled to the two driven pulleys 420 and 421 at the steering unit 400 and guided via the two pulleys 453*a, b* located at the connecting elements 450*a, b*. Next to each of the two driven pulleys 420, 421 two pairs of draw rolls 490*a, b*, 491*a, b* are provided that press a section of the loop against the driven pulleys 420, 421. In order to shorten and/or lengthen the loop with respect to one or the other side of the symmetry axis 410, in this arrangement the pulleys 420, 421 have to rotate in opposite directions. For example, if both pulleys 420, 421 are activated by the respective drive units to rotate in the directions indicated with arrows A and A', the part of the loop on the left hand side of the symmetry axis 410 is shortened and the part of the loop on the right hand side of the symmetry axis 410 is lengthened. When the two pulleys 420, 421 are activated by the respective drive units to rotate in the directions indicated with arrows B and B', the right hand side of the loop with respect to the symmetry axis 410 is shortened and the left hand side of the loop with respect to the symmetry axis 410 is lengthened.

The relieve line 470*a, b* follows this shortening and lengthening of the loop passively via the passive pulley 430. Both drive units that are coupled with the pulleys 420, 421 comprise means to block in the case of its failure. The blocking devices may be incorporated in the draw rolls 490*a, b*, 491*a, b*. For example, if the drive unit coupled to the pulley 421 fails, the draw rolls 491*a, b* can prevent the loop from passing via the pulley 421. In this case the loop is fixed at the driven pulley 421. Thus, an activation of the pulley 420 via the respective drive unit still results in shortening or lengthening the loop with respect to one or the other side of the symmetry axis 410, although only with speed and force of the drive unit coupled to pulley 420.

The invention has been explained with respect to specific embodiments. The following claims define the scope of the invention.

The invention claimed is:

1. An aerodynamic wind propulsion device for watercraft comprising an aerodynamic wing connected to a steering unit located below the aerodynamic wing via a plurality of tractive lines, at least one pair of active steering lines being connected to the aerodynamic wing at two points spaced apart from one another and being coupled to at least one drive unit at the steering unit, a tractive cable, a first end of the tractive cable being connected at the steering unit to at least two of the tractive lines and a second end of the tractive cable being connected to a base platform, the aerodynamic wing having an aerodynamic profile which generates an uplift force in the direction of the tractive cable when the airflow direction is about perpendicular to the tractive cable, two passive steering lines, wherein each of the two passive steering lines comprises a lower section and an upper section, wherein a second end of the lower section of each passive steering line is connected to a first end of the upper section of the respective passive steering line via a connecting member, wherein second ends of the upper sections of the two passive steering lines are connected to the aerodynamic wing at two points spaced apart from one another, and wherein first ends of the lower sections of the two passive steering lines are connected to each other to form a continuous passive steering line section passing through the steering unit in order to passively follow a deformation of the aerodynamic wing induced by steering forces applied to said at least one pair of active steering lines.

2. The device according to claim 1, wherein the at least one continuous passive steering line section is guided via a passive pulley located at the steering unit.

3. An aerodynamic wind propulsion device for watercraft comprising:

an aerodynamic wing being connected to a steering unit located below the aerodynamic wing via a plurality of tractive lines;

at least one pair of active steering lines being connected to the aerodynamic wing at two points spaced apart from one another and being coupled to at least one drive unit at the steering unit; and a tractive cable, a first end of the tractive cable being connected at the steering unit to at least two of the tractive lines and a second end of the tractive cable being connected to a base platform, the aerodynamic wing having an aerodynamic profile which generates an uplift force in the direction of the tractive cable when the airflow direction is about perpendicular to the tractive cable, wherein the first end of the tractive cable is directly secured to a connecting element located at the steering unit, at least one of the tractive lines is also directly secured to said connecting element, and said connecting element is configured to transfer tractive forces between the tractive cable and said at least one tractive line.

4. An aerodynamic device according to claim 3, wherein the tractive cable and the at least one tractive line are wound around said connecting element.

5. An aerodynamic wind propulsion device for watercraft comprising:

an aerodynamic wing connected to a steering unit located below the aerodynamic wing via a plurality of tractive lines;

at least one pair of active steering lines being connected to the aerodynamic wing at two points spaced apart from one another and being coupled to at least one drive unit at the steering unit;

a tractive cable, a first end of the tractive cable being connected at the steering unit to at least two of the tractive lines and a second end of the tractive cable being connected to a base platform, the aerodynamic wing having an aerodynamic profile which generates an uplift force in the direction of the tractive cable when the airflow direction is about perpendicular to the tractive cable, wherein each of the two active steering lines comprises a lower section and an upper section, a second end of the lower section and a first end of the upper section being connected to each other via a connecting member, and a second end of the upper section being connected to the aerodynamic wing at one of the two points in distance, and first ends of the two lower sections of the two active steering lines being connected to each other in the region of the steering unit to form a continuous active steering line section that is coupled to the at least one drive unit and passing through the steering unit, characterized in that a first relieve line is guided via a first relieve line pulley located at the steering unit, a first end of the first relieve line is connected to the connecting member (350*a, b*) of one of the two active steering lines, and a second end of the first relieve line is connected to the connecting member of the other one of the two active steering lines.

6. The device according to claim 5,
wherein the first relieve line pulley and the at least one drive unit are located at distant points at the steering unit.

7. The device according to claim 5, characterized in that
a second relieve line is guided via a second relieve line pulley located at the steering unit,
a first end of said second relieve line is connected to the connecting member of a first one of the two active steering lines, and
a second end of said second relieve line is connected to the connecting member of the second one of the two active steering lines.

8. The device according to claim 5,
characterized by two steering lines or lower sections of two steering lines, respectively, which are connected to each other in the region of the steering unit to form the relieve line or one of the relieve lines, respectively.

9. The device according to claim 5,
characterized in that one or both of the relieve line pulleys is located coaxially to the at least one drive unit at the steering unit.

10. The device according to claim 5,
characterized in that at least one of the relieve line pulleys is a passive pulley.

11. The device according to claim 5,
characterized in that the first relieve line pulley is coupled to a second drive unit such that activation of at least one of the drive units results in shortening the continuous active steering line section or the first relieve line, respectively, with respect to one side and lengthening the continuous active steering line section or the first relieve line, respectively, with respect to the other side of a symmetry axis of the steering unit or the aerodynamic wing, respectively.

12. The device according to claim 11,
characterized in that each of the drive units comprises a blocking device configured to actively block the respective drive unit in case of drive unit failure.

13. The device according to claim 11, characterized in that
the continuous active steering line section and the first relieve line are connected to each other to form a loop.

14. The device according to claim 13, characterized in that
the connecting member of at least one of the two active steering lines comprises a pulley, and
said loop is guided via said pulley.

15. The device according to claim 14,
characterized in that one of said drive units is located below the other one at the steering unit, both drive units are coupled to drive pulleys located within the loop, and the loop is preferably pressed against the upper drive pulley by two guiding pulleys located at the steering unit.

16. A watercraft comprising an aerodynamic wind propulsion device, the aerodynamic wind propulsion device comprising:
an aerodynamic wing connected to a steering unit via a plurality of tractive lines,
at least one pair of active steering lines being connected to the aerodynamic wing at two points spaced apart from one another and being coupled to at least one drive unit at the steering unit,
a tractive cable, a first end of the tractive cable being connected at the steering unit to at least two of the tractive lines and a second end of the tractive cable being connected to a base platform,
the aerodynamic wing having an aerodynamic profile which generates an uplift force in the direction of the tractive cable when the airflow direction is about perpendicular to the tractive cable, and
two passive steering lines, wherein ends of the two passive steering lines are connected to each other in the region of the steering unit to form a continuous passive steering line section passing through the steering unit in order to passively follow a deformation of the aerodynamic wing induced by steering forces applied to said at least one pair of active steering lines.

17. A method for using an aerodynamic wind propulsion device to start, land and fly an aerodynamic wing, the aerodynamic wind propulsion device comprising an aerodynamic wing connected to a steering unit via a plurality of tractive lines,
steering the aerodynamic wing with at least one pair of active steering lines, the steering lines being connected to the aerodynamic wing at two points spaced apart from one another and being coupled to at least one drive unit at the steering unit,
towing a vessel via a tractive cable, a first end of the tractive cable being connected at the steering unit to at least two of the tractive lines and a second end of the tractive cable being connected to a base platform,
the aerodynamic wing having an aerodynamic profile which generates an uplift force in the direction of the tractive cable when the airflow direction is about perpendicular to the tractive cable, and
securing the aerodynamic wing with two passive steering lines, wherein ends of the two passive steering lines are connected to each other to form a continuous passive steering line section passing through the steering unit in order to passively follow a deformation of the aerodynamic wing induced by steering forces applied to said at least one pair of active steering lines.

18. A method for controlling an aerodynamic wind propulsion device for watercraft wherein
an aerodynamic wing is connected to a steering unit located below the aerodynamic wing via a plurality of tractive lines,
at least one pair of active steering lines is connected to the aerodynamic wing at two points spaced apart from one another and coupling said at least one pair of active steering lines to at least one drive unit at the steering unit, and
a first end of a tractive cable at the steering unit is connected to at least two of the tractive lines and a second end of said tractive cable is connected to a base platform,
comprising the steps of:
applying steering forces to said at least one pair of active steering lines,
providing two passive steering lines, each of the two passive steering lines
connecting to the aerodynamic wing at two points spaced apart from one another, and
connecting ends of the two passive steering lines to each other in the region of the steering unit to form a continuous passive steering line section passing through the steering unit.

19. The method according to claim 18,
characterized by the step of:
guiding at least one continuous passive steering section line via a passive pulley located at the steering unit.

20. The method according to claim 18, characterized by the steps of:
directly securing the first end of the tractive cable to a connecting component located at the steering unit, directly securing at least one of the tractive lines to said connecting component, and transferring tractive forces between the tractive cable and said at least one tractive line via said connecting component.

21. The method according to claim 20, characterized by the step winding the tractive cable and the at least one tractive line around said connecting component.

22. The method according to claim 18, comprising the steps providing each of the two active steering lines with a lower section and an upper section, connecting second ends of the lower sections and first ends of the respective upper sections to each other via connecting members connecting second ends of the upper sections to the aerodynamic wing at the two points in distance, connecting first ends of the two lower sections of the two active steering lines to each other in the region of the steering unit to form a continuous active steering line section that is coupled to the at least one drive unit passing through the steering unit, guiding a first relieve line via a first relieve line pulley (330) located at the steering unit, connecting a first end of the first relieve line to the connecting member of one of the two active steering lines, and connecting a second end of the first relieve line to the connecting member of the other one of the two active steering lines.

23. The method according to claim 22, further comprising the steps of:

guiding a second relieve line via a second relieve line pulley located at the steering unit, connecting a first end of said second relieve line to the connecting member of a first one of the two active steering lines, and connecting a second end of said second relieve line to the connecting member of a second one of the two active steering lines.

24. The method according to claim 22, further comprising the step of:

connecting a pair of two steering lines or lower sections of a pair of two steering lines, respectively, to each other in the region of the steering unit to form the relieve line or one of the relieve lines, respectively.

25. The method according to claim 22, further comprising the step of:

guiding at least one of the relieve lines via a passive pulley.

26. The method according to claim 22, further comprising the steps of:

coupling the first relieve line pulley to a second drive unit, and shortening the continuous active steering line section or the first relieve line, respectively, with respect to one side and lengthening the continuous active steering line section or the first relieve line, respectively, with respect to the other side of a symmetry axis of the steering unit or the aerodynamic wing, respectively, by activating at least one of the drive units.

27. The method according to claim 26, further comprising the step of:

actively blocking one of the drive units, particularly in a mechanical manner, in case said drive unit fails.

28. The method according to claim 27, further comprising the step of:

connecting the continuous active steering line section and the first relieve line to each other to form a loop.

29. The method according to claim 28, further comprising the steps of:

providing a pulley at the connecting member of at least one of the two active steering lines, and guiding said loop via said pulley.

30. The method according to claim 18, further comprising the steps of:

primarily accommodating applied steering forces by the active steering lines or the continuous active steering line section, respectively, and primarily accommodating steering forces, forces resulting from the uplift force generated by the aerodynamic profile of the aerodynamic wing and/or forces resulting from a deformation of the aerodynamic wing by the first relieve line.

* * * * *